US005795387A

United States Patent [19]

Huerta

[11] Patent Number: 5,795,387

[45] Date of Patent: Aug. 18, 1998

[54] WALLPAPER PASTE APPLYING APPARATUS

[76] Inventor: Joe A. Huerta, 12634 S. 35th Pl., Phoenix, Ariz. 85044

[21] Appl. No.: 818,122

[22] Filed: Mar. 14, 1997

[51] Int. Cl.[6] ..... B05C 1/00

[52] U.S. Cl. ..... 118/244; 118/252; 118/258; 118/DIG. 17; 118/123; 156/575

[58] Field of Search ..... 118/123, 244, 118/252, 258, DIG. 17; 156/578, 575; 427/207.1, 428

[56] References Cited

U.S. PATENT DOCUMENTS

D. 325,152 4/1992 Poole et al. .

2,264,501 12/1941 Beach ..... 118/DIG. 17

5,330,575 7/1994 Poole et al. ..... 118/123

*Primary Examiner*—Laura Edwards

*Attorney, Agent, or Firm*—Parsons & Goltry; Robert A. Parsons; Michael W. Goltry

[57] ABSTRACT

An apparatus including a trough having an upstream end, a downstream end and opposing sidewalls, an applicator roller carried by the trough, an adjustable scraper bar carried by the trough upstream of and adjacent to the applicator roller, an adjustment assembly for adjusting the scraper bar for allowing a user to adjust the amount of paste removed from the surface of the wallpaper, a lid removably and hingedly coupled to the trough for movement between an open position and a closed position, and an outfeed roller carried proximate the trough upstream of the scraper bar.

23 Claims, 5 Drawing Sheets

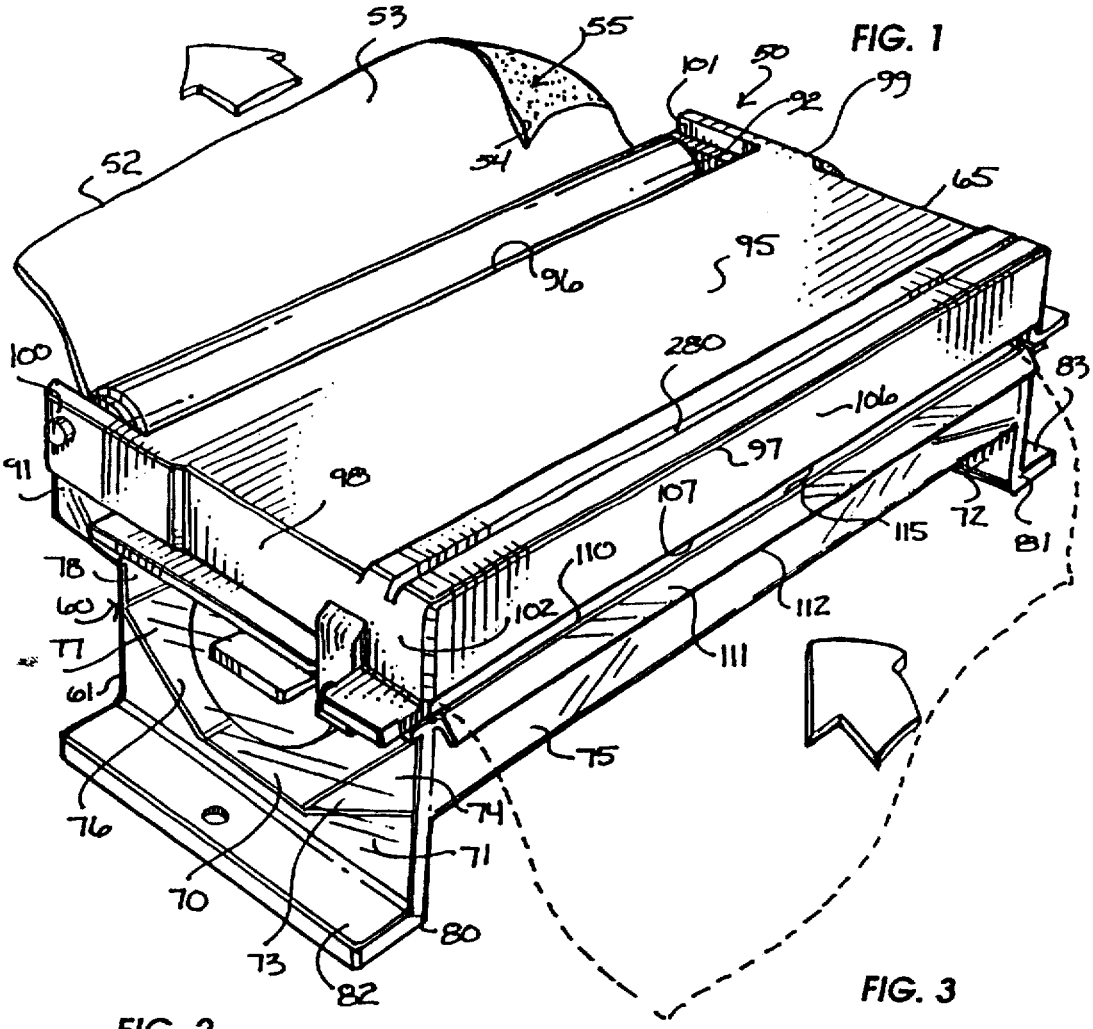
FIG. 1
FIG. 2
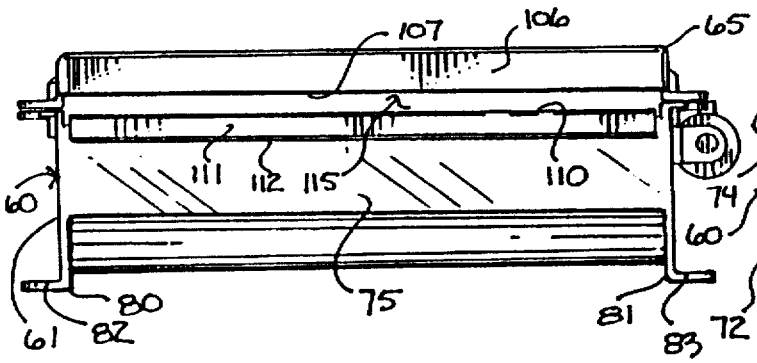
FIG. 3
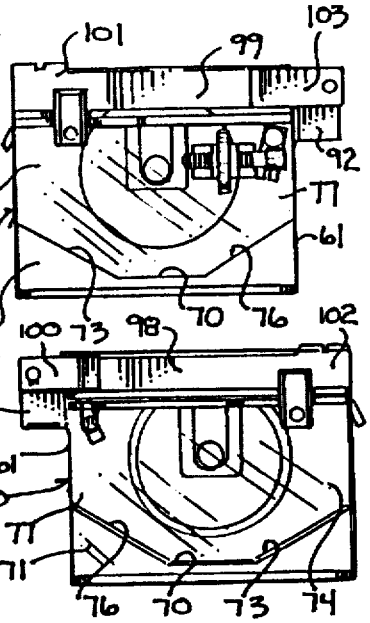
FIG. 4

WALLPAPER PASTE APPLYING APPARATUS

BACKGROUND OF THE INVENTION

1. Field of the Invention

This invention relates applicators.

More particularly, the present invention relates to devices for applying material to a surface.

In a further and more specific aspect, the present invention relates to a device for applying adhesive wallpaper paste to wallpaper.

2. Prior Art

The practice of hanging wallpaper on walls has long been observed, and has progressed through a large number of devices intended to simplify and increase the speed and efficiency of paper hanging. Hanging paper essentially consists of extracting a measured length of wallpaper from a roll. The paper has a pattern or design on a front surface and is blank on the opposing or back surface. A paste, used to affix the wallpaper to the wall, is applied to the back surface. The length of paper is then applied to the wall, paste covered side against the surface of the wall.

Different devices have been developed for the different steps in the procedure, some devices combining multiple, or even all of the steps. However, the present device is concerned with the preparation of a length of paper, that is, applying paste to the back surface of a length of wallpaper.

Traditionally, a measured length of paper is cut from a roll, placed pattern side down on a flat surface, the back surface coated with paste using a hand wielded brush. The obvious advantages to this approach is its simplicity and cost effectiveness. There are, however, major drawbacks. Specifically, the paste is very difficult to apply uniformly and of a specific thickness. This procedure is also very time consuming and can create a mess requiring further time spent in cleaning. Furthermore, a sufficiently large surface to work upon such as a table or board may not be present, and the floor may be unsuitable. There is also the possibility of unintentionally depositing paste on the design surface marring its appearance.

A further approach to applying paste to wallpaper is the use of a paste tray, through which the paper can be pulled. This can become very messy, and uniform application of paste is very difficult. A brush is generally required to redistribute the paste. Addition of rollers for supporting the paper and applying the paste has been the answer to many of these problems. However, new problems have resulted from these innovations.

Generally, paste applicators include a tray for holding a supply of paste. An applicator roller spins through the paste and applies it to the back surface of wallpaper as the paper passes over it. A second roller is also used, around which the wallpaper is pulled, guiding it over the applicator roller. While these devices successfully apply paste, the paste may be uneven and applied with a thickness difficult to control.

The uneven application of paste results largely from the uneven uptake of paste by the applicator roller. Wallpaper paste tends to have a viscous consistency which prevents it from flowing freely. This results in the applicator roller pushing paste to the fore and rear of the tray holding the paste, and creating a void around the applicator roller. Therefore, the applicator picks up the paste unevenly and does not deposit it uniformly on the wallpaper.

Furthermore, the amount of paste applied generally depends on the viscosity of the paste. In other words, the amount of paste applied generally depends on how much paste the applicator roller can pick up. This is very difficult to control, resulting in a non-uniform layer of paste having an unknown thickness.

One of the biggest problems with paste applicators is cleaning up the apparatus after it has been used. As stated above, wallpaper paste tends to be viscous, clinging to all of the surfaces and elements to which it comes into contact. Since hanging pasted wallpaper on a wall is time consuming, many times the paste is partially dried by the time cleaning is attempted. This makes cleaning difficult, with hard to reach places around rollers and in corners almost impossible to clean.

It would be highly advantageous, therefore, to remedy the foregoing and other deficiencies inherent in the prior art.

Accordingly, it is an object of the present invention to provide a new and improved wallpaper paste applying apparatus.

Another object of the present invention is to provide a wallpaper paste applying apparatus which applies a uniform coating of paste to wallpaper.

And another object of the present invention is to provide a wallpaper paste applying apparatus which applies paste in such a manner as to allow the thickness of the paste to be visually inspected.

Still another object of the present invention is to provide a wallpaper paste applying apparatus which may be adjusted to apply a desired thickness of paste to wallpaper.

Yet another object of the present invention is to provide a wallpaper paste applying apparatus which can be easily disassembled for easy cleaning.

Yet still another object of the present invention is to provide a wallpaper paste applying apparatus which can accommodate substantially any wallpaper width.

And a further object of the present invention is to provide a wallpaper paste applying apparatus that is easy to construct.

And yet a further object of the present invention is to provide a wallpaper paste applying apparatus that is easy to use.

Another object of the present invention is to provide a wallpaper paste applying apparatus that is relatively inexpensive.

And another object of the present invention is to provide a wallpaper paste applying apparatus that is efficient.

And yet another object of the present invention is to provide, in combination with a wallpaper paste applying apparatus, an adjustable scraper bar assembly operative for regulating the manner and thickness of paste to be applied to wallpaper.

SUMMARY OF THE INVENTION

Briefly, to achieve the desired objects of the instant invention in accordance with a preferred embodiment thereof, provided is a wallpaper paste applying apparatus for applying paste to a surface of wallpaper. In a specific embodiment, the wallpaper paste applying apparatus includes a trough having an upstream end, a downstream end and opposing sidewalls. Further included is an applicator roller carried by the trough and an adjustable scraper bar assembly including, among other things, a scraper bar adjustably carried by the trough upstream of and adjacent to the applicator roller. The scraper bar includes an elongate member extending proximate a location intermediate the opposing sidewalls of the trough. The elongate member is provided with a scraper portion located at a height proximate the back surface of the wallpaper to remove a predetermined amount of paste from the surface of the wallpaper. The adjustable scraper bar assembly of the wallpaper paste applying apparatus further includes an adjustment assembly for adjusting the height of the scraper portion for allowing a user to adjust the amount of paste removed from the surface of the wallpaper. Further included is a lid carried by the trough in a manner generally superjacent relative the applicator roller, and an outfeed roller carried proximate the trough upstream of the scraper bar. With respect a preferred embodiment, the lid is removably and hingedly coupled to the trough for movement between an open position and a closed position.

The scraper portion of the scraper bar preferably includes an apex extending longitudinally along the elongate member, and a beveled scraper surface contiguous with said apex and directed toward the surface of the wallpaper. The beveled scraper surface preferably includes a plurality of wales disposed therealong in spaced-apart relation and each separated by one of a plurality of valleys each having a predetermined depth. In this manner of construction, the apex and the plurality of wales contact the surface of the wallpaper to remove paste therefrom to form a layer of paste upon the back surface of the wallpaper, the layer defined by a plurality of ribs of paste corresponding to the plurality of valleys each separated by one of a plurality of grooves each formed by one of the plurality of wales.

In a particular embodiment, the scraper bar may further include a first post rigidly carried by the elongate member and extending outwardly from a first end thereof, and a second post rigidly carried by the elongate member and extending outwardly from a second end thereof. The first post is rotatably and removably receivable by a groove formed into one of the opposing sidewalls and extending outwardly therefrom and terminating with an outer end at a point generally outboard of an outer surface of the one of the opposing sidewalls. Furthermore, the second post is rotatably and removably receivable by another groove formed into the other of the opposing sidewalls and extending outwardly therefrom and terminating with an outer end at a position generally outboard of an outer surface of the other of the opposing sidewalls.

With this in mind, the adjustment assembly may be carried by scraper bar proximate the first post or the second post. However, in a specific embodiment, the adjustment assembly may be carried proximate the outer end of the first post, with means carried by other portions of the scraper bar for rigidly securing the elongate member to the trough.

Consistent with the teachings of the present invention, the adjustment assembly includes an adjustment member rigidly carried proximate the outer end of the first post, the adjustment member being movable in a predetermined direction for moving the scraper portion either toward or away from the surface of the wallpaper. The adjustment member may be either detachably or permanently engaged to the outer end of the first post, although this is not essential.

The adjustment assembly may further include a pointer carried by the adjustment member and indicia carried by the wallpaper paste applying apparatus corresponding to the pointer, the indicia defining varying degrees of height of the scraper portion.

In a specific embodiment, the lid of the wallpaper paste applying apparatus of the present invention may include a panel having a trailing edge pivotally and removably mounted proximate the downstream end of the trough, a leading edge, opposing sidewalls and a pair of engagement assemblies each carried proximate the leading edge of the panel of the lid and proximate the upstream end of the trough, each one of the pair of engagement assemblies for detachably engaging the leading edge of the panel to the trough proximate the upstream end.

Each one of the pair of engagement assemblies includes an engagement element of an engagement pair extending downwardly proximate the leading edge of the panel, and a complemental engagement element of the engagement pair carried by the trough proximate the upstream end, the engagement element detachably engagable to the complemental engagement element for allowing a user to selectively close and open the lid.

In another embodiment, the lid of the present invention may include a panel having an inner surface superjacent an apex of the applicator roller, a trailing edge mounted proximate the downstream end of the trough, and a leading edge mounted proximate the upstream end of the trough. The lid may further include a first aspect depending from the inner surface of the lid and terminating with a lower end located intermediate the applicator roller and the upstream end subjacent the apex of the applicator roller, and a second aspect spaced from the first aspect, depending from the inner surface of the lid and terminating with a lower end located intermediate the applicator roller and the downstream end subjacent the apex of the applicator roller. In this manner of construction, the first aspect and the second aspect are operative for holding the wallpaper onto and over the applicator roller as the wallpaper is fed through the wallpaper paste applying apparatus. The first and second aspects may each be comprised of a rib extending longitudinally therealong the inner surface of the lid and further extending along substantially the entire length of the applicator roller.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 1 is a perspective view of a wallpaper paste applying apparatus, in accordance with a preferred embodiment of the present invention;

FIG. 2 is a front elevational view of the wallpaper paste applying apparatus of FIG. 1;

FIG. 3 is a side elevational view of the wallpaper paste applying apparatus of FIG. 1;

FIG. 4 is another side elevational view of the wallpaper paste applying apparatus of FIG. 1;

DETAILED DESCRIPTION OF THE PREFERRED EMBODIMENT

Figure 5:
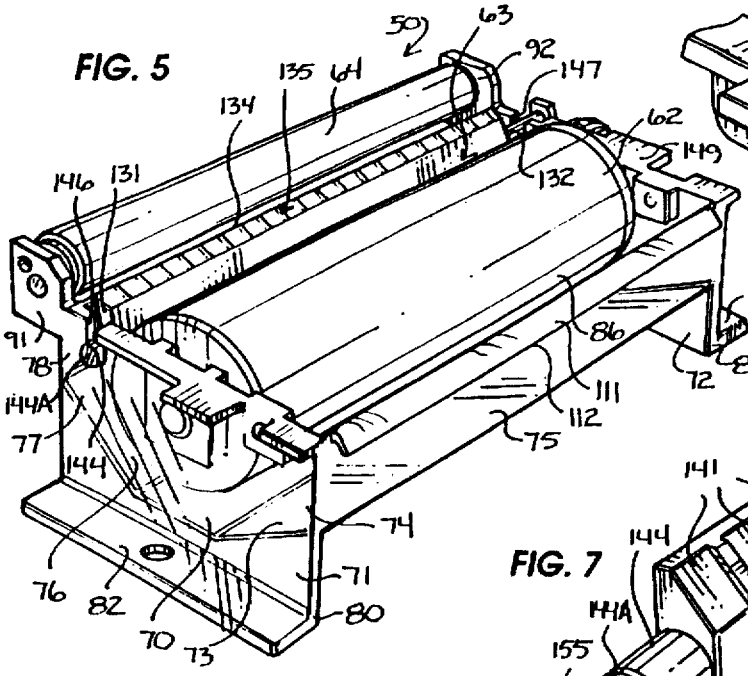
FIG. 5 is a perspective view of the wallpaper paste applying apparatus of FIG. 1 shown with portions thereof removed for the purposes of illustrating an applicator roller carried proximate a trough.

Turning now to the drawings, in which like reference characters indicate corresponding elements throughout the several views, attention is first directed to FIG. 1 which illustrates a first embodiment of the present invention comprising a wallpaper paste applying apparatus generally designated by the reference character 50 into which wallpaper 52, having a front surface 53 and a back surface 54, is inserted. Wallpaper 52, generally supplied in the form of a roll (not shown), is inserted, paste 55 is applied to back surface 54, and a segment of wallpaper 52, of sufficient and selected length, is cutoff. It will be generally understood by those having ordinary skill in the art that a pre-cut length of wallpaper 52 may be inserted into wallpaper paste applying apparatus 50, without the need to accommodate a roll.

With further reference to FIGS. 2–5, wallpaper paste applying apparatus 50 includes a housing 60 having a trough 61 supporting an applicator roller 62, a scraper bar 63, an outfeed roller 64 and a lid 65 carried by trough 61 in a manner superjacent applicator roller 62. With respect to the preferred embodiment, lid 65 is hingedly and removably coupled to trough 61, further details of which will be discussed shortly. Trough 61 holds paste 55 (not shown in trough 61) which applicator roller 62 picks up and applies to wallpaper 52 in a manner to be discussed shortly.

As illustrated in relevant part, trough 61 includes a floor 70, opposing sidewalls 71 and 72 extending upwardly from floor 70, an upstream endwall 73 extending upwardly and forwardly from floor 70 at an upstream end 74 of trough 61 with an upstream panel 75 extending upwardly therefrom, and a downstream endwall 76 extending upwardly and rearwardly from floor 70 at a downstream end 77 of trough 61 with a downstream panel 78 extending upwardly therefrom. For the purposes of present discussion, upstream and downstream refer to the direction in which wallpaper 52 passes through wallpaper paste applying apparatus 50, which is from upstream end 74 to downstream end 77.

Trough 61 is of a width sufficient to accommodate wallpaper of substantially any desired width and thickness. Sidewalls 71 and 72 each include a lower end 80 and 81 having a laterally and outwardly extending foot 82 and 83 for bearing against and supporting wallpaper paste applying apparatus 50 upon a surface.

With specific attention to FIG. 5, applicator roller 62, which includes a cylindrical body 86 having an outer surface 87 for picking up paste 55 from trough 61, is rotatably supported between sidewalls 71 and 72 and is positioned adjacent floor 70 intermediate upstream endwall 73 and downstream endwall 76. Scraper bar 63 is also provided removably and adjustably carried by housing 60 proximate trough 61 upstream of and adjacent to applicator roller 62. Outfeed roller 64 is correspondingly positioned upstream of and adjacent to scraper bar 90 and is rotatably supported by a pair of braces 91 and 92 extending upwardly and rearwardly from sidewalls 71 and 72 of housing 60.

As shown in FIG. 1, lid 65, movable between an open and a closed position as shown, is operative for enclosing trough 61 and includes a substantially planar panel 95 having a trailing edge 96, a leading edge 97 and opposing sidewalls 98 and 99 extending downwardly therefrom. Each one of the sidewalls 98 and 99, respectively, includes a trailing end 100 and 101 pivotally and removably mounted to a brace 91 and 92, respectively, of housing 60, proximate downstream end 77 of trough 61, and a leading end 102 and 103 (FIG. 3) detachably engagable to trough 61 proximate upstream end 74 thereof. With additional reference to FIG. 2, lid 65 further includes a front endwall 106 extending downwardly from leading edge 97 and terminates with a lower edge 107 extending longitudinally along substantially the entire width of trough 61.

As illustrated in FIG. 2, upstream panel 75 extends upwardly from upstream endwall 73 and terminates with a longitudinally extending upper edge 110 having a flange 111 extending outwardly and downwardly therefrom and terminating with an outer end 112 at a point generally outboard of the upstream end 74 of trough 61. With lid 65 in the closed position as shown in FIG. 2, upper edge 110 of upstream panel 75 and lower edge 107 of front endwall 106 of lid 65 define a slot 115 operative for receiving wallpaper therethrough in the direction indicated by arrow A in FIG. 1 and into wallpaper paste applying apparatus 50 toward downstream end 77. After passing through wall paper paste applying apparatus 50 in a manner to be presently discussed, wallpaper emerges outwardly through downstream end 77 from outfeed roller 64 in the direction indicated by arrow B in FIG. 1.

Figure 9:
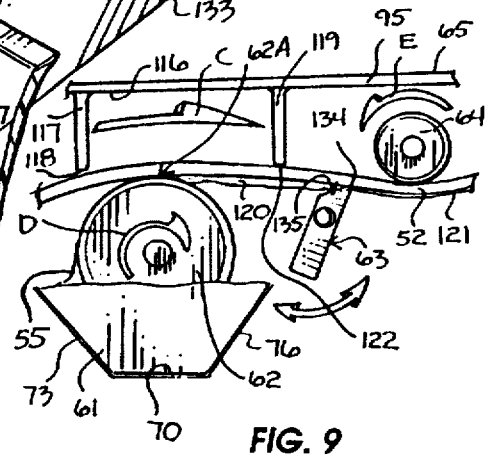
FIG. 9 is a spatial representation of an applicator roller positioned to receive paste carried by a trough, with outfeed roller and a scraper bar located intermediate the applicator roller and the outfeed roller, the spatial representation further illustrating wallpaper receiving paste from the applicator roller with excess paste being removed from the wallpaper by the scraper bar with the wallpaper feeding out from the outfeed roller.

To explain the operation of wallpaper paste applying apparatus, attention is drawn to the schematic spatial representation of FIG. 9. In operation, lid 65 will normally be positioned in the closed position as shown in FIG. 1. Lid 65 includes an inner surface 116 directed toward applicator roller 62 when lid 65 is disposed in the closed position. Lid 65 includes a first rib 117 depending from inner surface 116 of panel 95 and extending downwardly therefrom and terminating with a lower end 118 at a point upstream of applicator roller 62 and subjacent apex 62A of applicator roller 62. Lid further includes a second rib 119 depending from inner surface 116 of panel 95 and extending downwardly therefrom and terminating with a lower end 122 at a point downstream of applicator roller 62, upstream of scraper bar 63, and subjacent apex 62A of applicator roller 62 and subjacent an apex 134 of scraper bar 63. Further details of apex 134 will be discussed shortly. However, with respect to the preferred embodiment, first and second ribs 117 and 119 extend longitudinally along inner surface 116 along substantially the entire length of applicator roller 62, although this is not essential and first and second ribs 117 and 119 may extend longitudinally along less than substantially the entire length of applicator roller 62 if desired. Furthermore, first and second ribs 117 and 119 are disposed in spaced-apart relation and reside in substantially parallel planes relative one another.

In operation, wallpaper 52 is fed into wallpaper paste applying apparatus 50 in the direction indicated by arrow C (FIG. 9) through slot 115 shown in FIGS. 1–2 passing under lower end 118 of first rib 117, over applicator roller 62, under lower end 122 of second rib 119, over scraper bar 63, under outfeed roller 64 and outwardly from downstream end 77. Back surface 54 is held down onto and over applicator roller 62 by lower ends 118 and 122 of first and second ribs 117 and 119, respectively, as lower ends 118 and 122 bear against front surface 53 of wallpaper 52 as wallpaper 52 feeds through wallpaper paste applying apparatus 50. This forces wallpaper 52 onto applicator roller 62 and thus serves as the reason for lid 65 to be closed during operation. In this manner, as wallpaper 52 is drawn through wallpaper paste applying apparatus 50 in the direction of arrow C in FIG. 9, back surface 54 bears against applicator roller 62 thereby imparting rotational movement to applicator roller in the direction indicated by arcuate arrow D. As applicator roller 62 rotates, it passes through paste 55 held within trough 61 resulting in a substantial coating of paste 55 on applicator roller 62. As wallpaper 52 is drawn through wallpaper paste applying apparatus, paste 55 from applicator roller 62 becomes deposited in the form of a layer 120 upon back surface 54 of wallpaper 52 as applicator roller 62 rotates at a rate proportional to the movement of wallpaper 52. With scraper bar 63 located intermediate applicator roller 62 and outfeed roller 64, wallpaper 52 passes by scraper bar 63 which operates to engage layer 120 thereby removing and forming a predetermined and selected amount and manner of application of paste from and to back surface 54 thereby forming a layer 121 downstream of scraper bar 63 different from layer 120. After passing by scraper bar 63, front surface 53 of wallpaper 52 engages outfeed roller 64 thereby imparting rotational movement to outfeed roller 64 in the direction indicated by arcuate arrow E at a rate proportional to the movement of wallpaper 52 as it passes thereby and outwardly from downstream end 77 of trough 61 of wallpaper paste applying apparatus 50.

It will be generally understood that to draw wallpaper 52 through wallpaper paste applying apparatus 50, a user need only manually feed wallpaper 52 therethrough and grasp and manually pull wallpaper 52 outwardly from downstream end 77. However, this is not an essential feature of the present invention and mechanical means may also be incorporated to draw wallpaper 52 through wallpaper paste applying apparatus 50 if desired. Furthermore, although first and second ribs 117 and 119 have been disclosed as the preferred structural aspects operative for holding wallpaper 52 onto and over applicator roller 62, other similarly operative structural aspects may also be used in combination with lid 65 suitable for holding wallpaper 52 over and onto applicator roller 62 in the manner herein specifically described.

Figure 7:
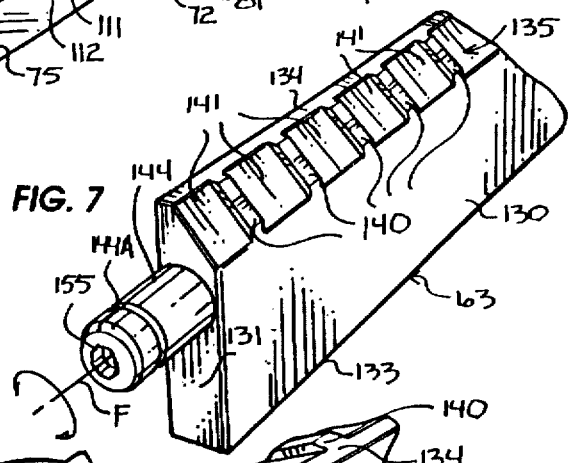
FIG. 7 is a fragmented perspective view of a scraper bar.
Figure 8:
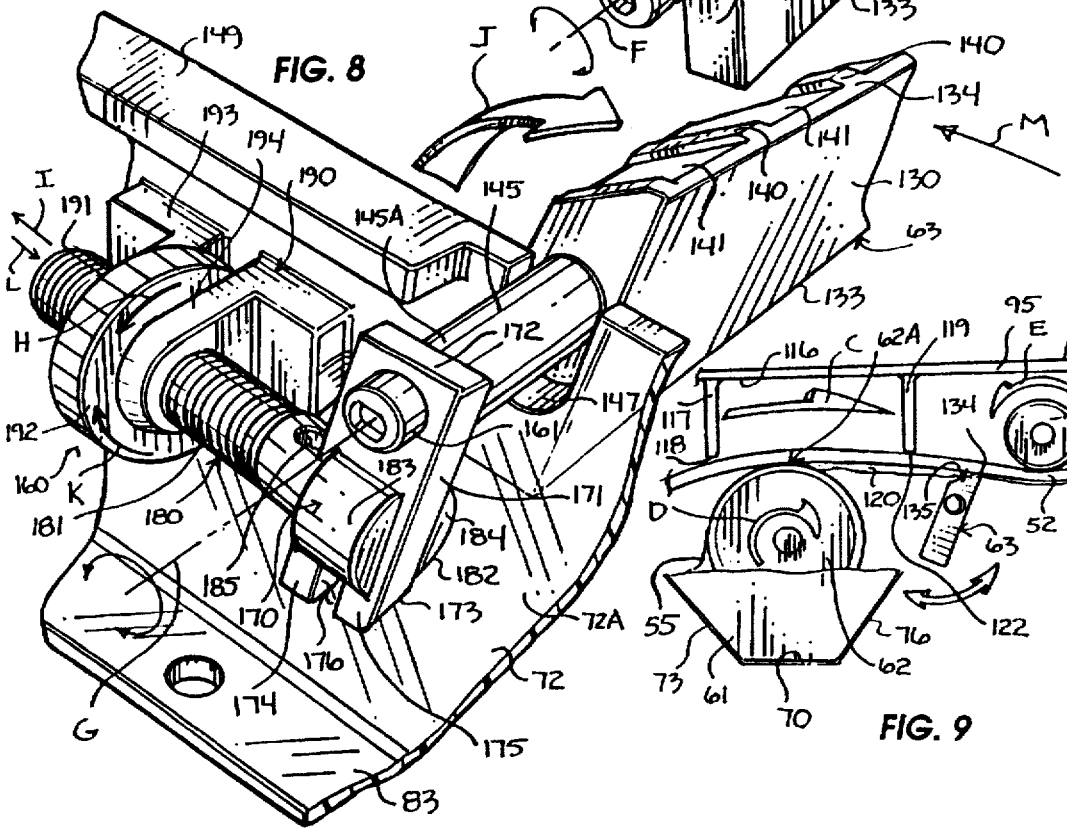
FIG. 8 is an enlarged fragmented perspective view of an adjustment assembly operative for adjusting a scraper bar.

With attention directed back to FIG. 5, and with additional reference to FIG. 7 and FIG. 8, scraper bar 63 extends between sidewalls 71 and 72 of trough 61 and includes an elongate member 130 having a first end 131, a second end 132, a lower end 133 and a scraper portion including an apex 134 extending longitudinally therealong elongate member 130 and contiguous with a beveled scraper surface generally designated by the reference character 135. As shown in FIG. 9, when scraper bar 63 is installed, beveled scraper surface 135 is directed generally toward back surface 54 of wallpaper 52 for reasons presently to appear. Beveled scraper surface 135 includes a plurality of ribs or wales 140 disposed therealong in spaced-apart relation separated by valleys 141 having a predetermined and selected depth. As shown in FIG. 9, when installed, apex 134 and beveled scraper surface 135 defining the scraper portion of scraper bar 63 are directed in an upward direction at a height proximate back surface 54 of wallpaper 52.

Scraper bar 63 further includes a first post 144 (FIG. 7) rigidly carried by elongate member 130 and extending outwardly from first end 131 and terminating with an outer end 144A, and a second post 145 (FIG. 8) rigidly carried by elongate member 130 and extending outwardly from second end 132 and terminating with an outer end 145A. First and second posts 144 and 145 are each rotatably and removably receivable within one of a pair of grooves 146 and 147 each formed through an upper edge 148 and 149 of each respective sidewall 71 and 72 and at a position generally upstream from applicator roller 62 and operative for supporting scraper bar 63 between sidewalls 71 and 72.

With first and second posts 144 and 145 received within slots 146 and 147, respectively, scraper bar 63 is supported between sidewalls 71 and 72 proximate trough 61 in a manner generally represented in FIG. 9 with apex 134 and beveled scraper surface 135 of the scraper portion of elongate member 130 directed toward back surface 54. As shown in FIG. 5, first post 144 extends outwardly with outer end 144A terminating at a point generally outboard of an outer surface 71A of sidewall 71. Second post 145 also extends outwardly with outer end 145A terminating at a point generally outboard of an outer surface 72A of sidewall 72.

Posts 144 and 145 of scraper bar 63 are not only rotatably and removably receivable within the respective grooves 146 and 147, post 144 and post 145 are also selectively securable to sidewalls 71 and 72, respectively, for securing scraper bar 63 in place and in a predetermined orientation. In this manner, and with attention directed to FIG. 7, outer end 144A of first post 144 is detachably engagable to a securement element 155. Securement element 155 is generally provided in the form of a nut or the like threadably and detachably engagable to outer end 144A in a conventional manner well known to those having ordinary skill. Thus, upon placement of first post 144 into groove 146, securement element 155 may be threadably secured to outer end 144A for rigidly securing first post 144 to portions of sidewall 72 defining groove 146.

In a different fashion, and as shown in FIG. 8, outer end 145A of second post 145 is shown detachably engaged to an adjustment assembly 160 by virtue of a securement element 161. Adjustment assembly 160, further details of which will be discussed presently, is operative for allowing a user to easily and selectively adjust the height of the scraper portion of scraper bar 63 for controlling or adjusting the thickness of layer 121. Securement element 161, like securement element 155, is preferably provided in the form of a nut or the like threadably and detachably engagable to outer end 145A in a conventional manner well known to those having ordinary skill.

Adjustment assembly 160 includes an armature 170 including a connector 171 having an upper end 172 rigidly and detachably coupled to outer end 145 of second post 145 by virtue of securement element 161, and extends downwardly therefrom and terminates with lower end 173 furcated into branches 174 and 175 separated by a slot 176. An adjustment bolt 180 is also provided and includes an elongate body 181 having a proximal end 182 furcated into branches 183 and 184 separated by a slot 185 sized to receive the width of connector 171. A pin (not shown) traverses slot 185 interconnecting the outer ends of branches 183 and 184 and is receivable within slot 176. By virtue of the foregoing arrangement, it will be understood by those skilled in the art that proximal end 182 of adjustment bolt 180 is coupled to lower end 173 of connector 171 in axial pivotal relation.

From lower end 173 of connector 171, elongate body 181 of adjustment bolt extends forwardly toward upstream end 74 through a bifurcated bracket 190 extending outwardly from outer surface 72A of sidewall 72 and terminates with a distal end 191. The outer surface of elongate body 181 is threaded from a location generally inboard of branches 183 and 184 to distal end 191 and is threadably received through bifurcated bracket 190 with an adjustment member 192 threadably carried by elongate body 181 intermediate furcations 193 and 194 which define bifurcated bracket 190.

As previously indicated, adjustment assembly 160 is operative for allowing a user to adjust or control the thickness of layer 121. In particular, when scraper bar 63 is installed, elongate member 130 may be selectively pivoted or rotated in a predetermined direction by adjustment assembly 160 along axis of rotation F defined by first post 144 and axis of rotation G defined by second post 145, of which are preferably common, although this is not essential. To rotatably or otherwise pivotally adjust elongate member 130 of scraper bar 63, it is normally necessary to loosen or otherwise either totally or partially disengage first post 144 from slot 146 by either partially or totally disengaging securement element 155 from outer end 144A so that first post 144 may rotate relative slot 146. A user may then grasp adjustment member 192 and rotate it in the direction indicated by the arcuate arrowed line H causing adjustment bolt 180 to threadably move through bifurcated bracket 190 in the direction indicated by the arrowed line I toward upstream end 74. As adjustment bolt moves in the direction indicated by the arrowed line I, lower end 173 of connector 171 is pulled by proximal end 182 in the same direction thereby imparting rotation to second post 145 and hence elongate member 130 in the direction indicated by arcuate arrow J in FIG. 8 thus pivoting apex 134 and beveled scraper surface 135 of the scraper portion of scraper bar 63 away from back surface 54 of wallpaper 52. In this manner, as the scraper portion of the scraper bar 63 is moved away from back surface 54 of wallpaper 52, apex 134 and beveled scraper surface 135 will engage a lesser amount of paste 55 defining layer 120 and consequently to remove less paste 55 from layer 120 as wallpaper 52 is drawn therethrough thereby resulting in a thicker layer 121 as desired by a user.

Alternatively, a user may grasp adjustment member 192 and rotate it in the direction indicated by the arcuate arrowed line K causing adjustment bolt 180 to threadably move through bifurcated bracket 190 in the direction indicated by the arrowed line L toward downstream end 77. As adjustment bolt moves in the direction indicated by the arrowed line L, lower end 173 of connector 171 is pushed by proximal end 182 in the same direction thereby imparting rotation to second post 145 and hence elongate member 130 in the direction indicated by arcuate arrow M in FIG. 8 thus pivoting apex 134 and beveled scraper surface 135 of the scraper portion of scraper bar 63 toward back surface 54 of wallpaper 52. In this manner, as the scraper portion of the scraper bar 63 is moved or otherwise adjusted toward back surface 54 of wallpaper 52, apex 134 and beveled scraper surface 135 will engage a greater amount of paste 55 defining layer 120 and consequently to remove a larger amount of paste 55 from layer 120 as wallpaper 52 is drawn therethrough thereby resulting in a thinner layer 121 as desired by a user.

After adjusting the scraper portion of scraper bar 63 in a predetermined fashion pursuant to the foregoing discussion, securement element 155 may then be secured to outer end 144A of first post 144 for rigidly and detachably engaging post 144 to portions of sidewall 71 defining groove 146 for rigidly securing scraper bar 63 in a predetermined and selected position. Furthermore, it will be readily appreciated by those having ordinary skill, that rotation of adjustment member 192 in the directions indicated by arcuate arrowed lines H and K have been discussed merely for the purposes of illustration, and that these rotational directions may be reversed depending upon the threaded nature of adjustment bolt 180.

The foregoing adjustable feature of scraper bar 63 of the present invention is particularly advantageous for allowing a user to selectively control the thickness of layer 121 of paste 55 upon back surface 54 of wallpaper 52 prior to placing wallpaper 52 upon a surface such as the surface of a wall. Another advantageous feature of scraper bar 63 is the nature of beveled scraper surface 135. In this regard, as wallpaper 52 traverses scraper bar 63 as it moves upstream through wallpaper paste applying apparatus 50, apex 134 and portions of wales 140 contiguous with apex 134 engage layer 120 of paste 55. As a result, paste 55 defining layer 121 not only includes a predetermined thickness, but is channeled through valleys 141 and thereby altered to take the form of ribs corresponding to valleys 141 as ultimately deposited upon back surface 54. Thus, instead of having an even layer of paste 55 upon back surface 54, layer 121 is defined by a plurality of longitudinally extending ribs corresponding to the shape of valleys 141 and having a corresponding thickness depending on the height to which the scraper portion of scraper bar 63 resides. In this regard, as back surface 54 of wallpaper 52 is positioned upon a surface for hanging, the plurality of longitudinally extending ribs of paste 55 defining layer 121 spread out to enclose the gaps separating the longitudinally extending ribs of paste 55 formed by wales 140 resulting in an even distribution of paste 55 along back surface 54 for facilitating not only exemplary adhesion of back surface 54 to a selected surface, but also for inhibiting excess paste 55 from undesirably emerging or oozing outwardly beyond the periphery of wallpaper 52.

Furthermore, as paste 55 is removed from layer 120 as wallpaper 52 traverses scraper bar 63, the excess paste 55 is channeled downwardly along each respective valley 141. Because scraper bar is advantageously positioned proximate trough 61, the excess paste 55 emerges downwardly from valleys 141 for efficient deposit within trough 61.

Consistent with the teachings of the present invention, the manner in which scraper bar 63 may be pivotally or otherwise rotatably adjusted for consequently adjusting the height of the scraper portion may be carried out in a variety of fashions suitable for increasing the efficiency and accuracy of adjustment thereof. Furthermore, although adjustment assembly 160 previously discussed has been disclosed as being carried by second post 145, it will be readily understood that adjustment assembly 160, and alternate embodiments thereof to be herein discussed, may be alternatively carried by first post 144 if desired without departing from the nature and scope of the present invention as herein specifically disclosed.

Figure 10:
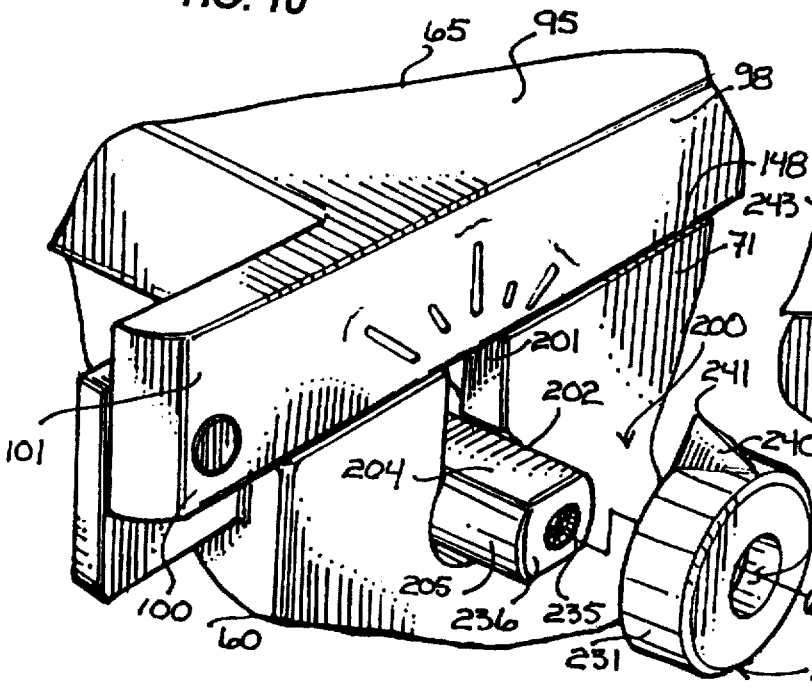
FIG. 10 is an enlarged fragmented perspective view of an alternate embodiment of an adjustment assembly operative for adjusting and indicating the height of a scraper bar.
Figure 11:
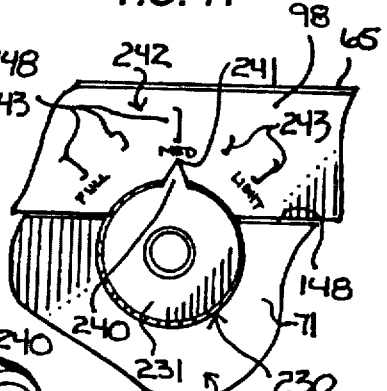
FIG. 11 is a front elevational view of the adjustment assembly of FIG. 10.
Figure 15:
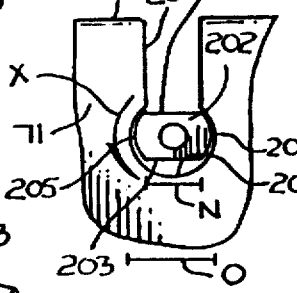
FIG. 15 is a schematic side elevational view somewhat similar to the view of FIG. 14, with a post of a scraper bar shown positioned within a groove formed in a sidewall of a trough.
Figure 14:
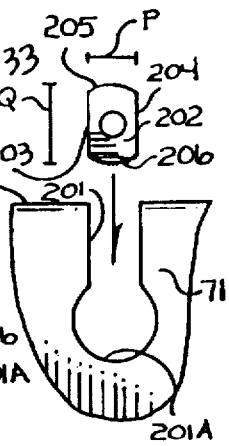
FIG. 14 is a schematic side elevational view of a post of a scraper bar of the present invention shown positioned proximate a groove formed in a sidewall of a trough.

In this regard, attention is directed to FIG. 10 and FIG. 11 which together illustrate an alternate embodiment of an adjustment assembly 200 operative for not only adjusting but also indicating the height of scraper bar 63. However, prior to discussing adjustment assembly 200, and with additional reference to FIGS. 14–15, shown is an alternate embodiment of groove 146 designated by the reference character 201, and an alternate embodiment of first post 144 designated by the reference character 202. In this regard, groove 201 extends downwardly from upper edge 148 of sidewall 71 defining a width N and terminates with an enlarged portion 201A defining a width O greater than width N. Furthermore, first post 202 includes opposed planar surfaces 203 and 204 defining a width P somewhat smaller than width N of groove 201, and opposed arcuate surfaces 205 and 206 defining a width Q greater than width N of groove 201 but somewhat smaller than width O of enlarged portion 201A.

With continuing reference to FIGS. 14–15, installation of first post 202 may be carried out by orienting width P of second post to correspond with width N of groove 201 and inserting first post 202 into enlarged portion 201A though width N of groove 201. Upon receipt of first post 202 into enlarged portion 201A, first post 202 may be rotated axially along its axis of rotation such as in the direction indicated by the arcuate arrowed line X in FIG. 15 thus engaging the opposed arcuate surfaces 205 and 206 of first post 202 with the width ) of enlarged portion 201A to rotatably retain first post 202 therein.

Figure 12:
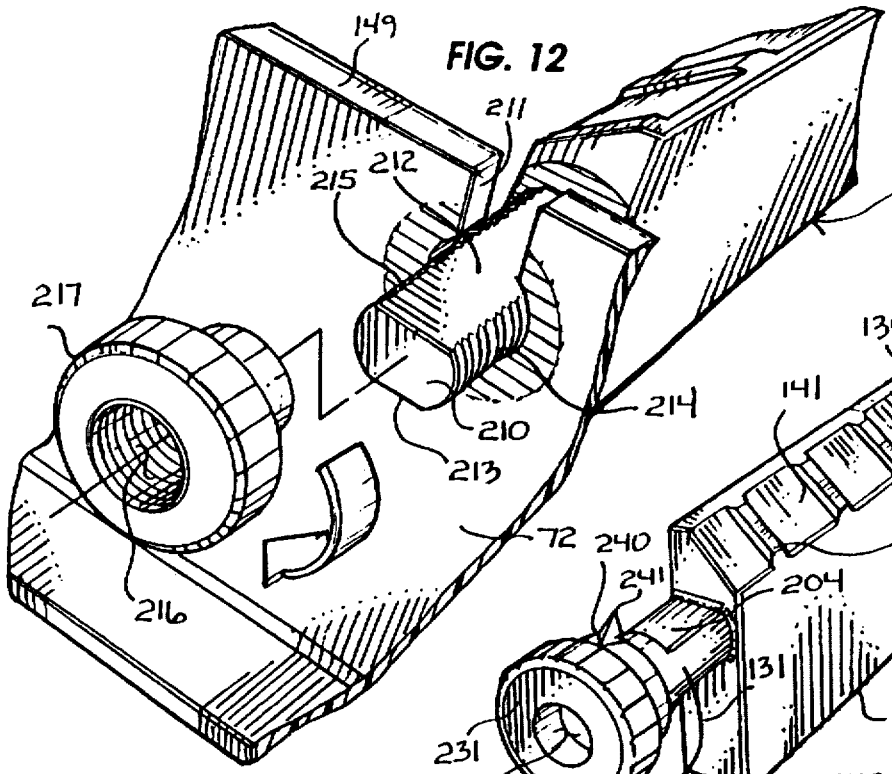
FIG. 12 is an enlarged partially exploded perspective view of a post of a scraper bar shown positioned within a groove of a sidewall of a trough thereof with a securement element shown as it would appear prior to engagement with the post.

It will be readily understood by those having ordinary skill that second post 145 and groove 147 may, if desired, be constructed in substantially the same manner as first post 202 and groove 201 as herein specifically discussed and as shown in FIG. 12, although this is not essential. In this regard, an alternate embodiment of second post 145 and groove 147 are shown in FIG. 12 and are designated by the reference characters 210 and 211, respectively. Like first post 202, second post 210 includes opposed planar surfaces 212 and 213 and opposed arcuate surfaces 214 and 215 which are, however, threaded and operative to threadably and detachably engaged a threaded bore 216 of a securement element 217 upon rotation of securement element 217 in a predetermined and selected direction suitable for detachably and securably engaging second post 210 to portions of sidewall 72 defining groove 211 for securing the scraper portion of scraper bar 63 in a predetermined and selected height consistent with the foregoing discussion.

Figure 13:
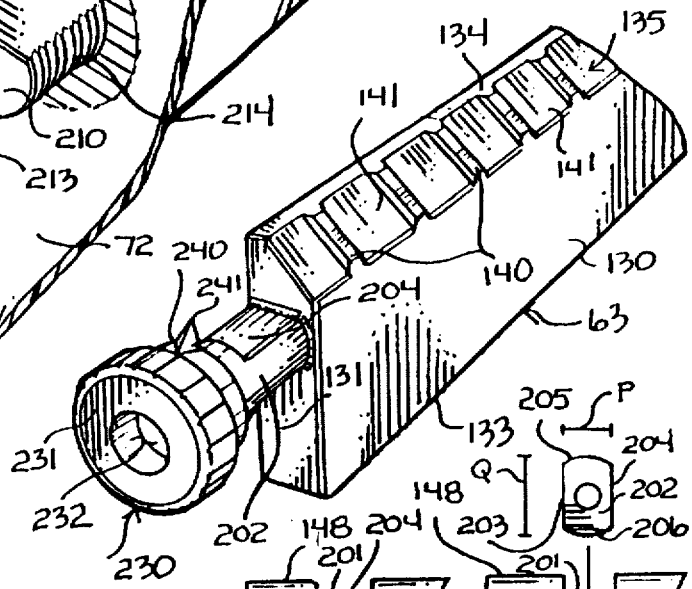
FIG. 13 is an enlarged fragmented perspective view of a scraper bar of the present invention shown having a post with an adjustment element coupled thereto.

With attention directed back to FIG. 10, adjustment assembly 200 includes an adjustment member 230 generally comprised of a generally cylindrical member 231 having a bore 232 extending therethrough, and adapted to be carried by first post 202. In this regard, also included is an engagement member 233 receivable through bore 232 and having an threaded engagement element 234 detachably and threadably engagable to a threaded bore 235 extending inwardly into first post 202 from an outer end 236 thereof operative for detachably and securably engaging adjustment member 230 to outer end 236 of first post 202 as shown in FIG. 13, although other engagement means may be used. It will be readily understood by those skilled in the art that although adjustment member 230 has been herein disclosed as being detachably engagable to outer end 236 of first post 202, this is not an essential feature of the present invention and adjustment member 230 may otherwise be permanently attached to first post 202 if desired.

Regarding adjustment assembly 200, and with attention directed back to FIGS. 10–11, adjustment member 230 further includes a pointer or protrusion 240 extending laterally outwardly therefrom and terminating with an outer end 241 formed generally in the form of a point. Outer end 241 is so oriented to generally correspond to indicia 242 carried by portions of sidewall 98 of lid 65 of wallpaper paste applying apparatus 50. Although indicia 242 may be provided in a variety of forms consistent with the teachings of the present invention, indicia 242 is preferably provided in the form marks 243 extending radially upwardly along sidewall 98, each one of the plurality of marks 243 corresponding to a predetermined height of the scraper portion of scraper bar 63. Thus, when adjusting the height of the scraper portion of scraper bar 63, a user may easily adjust the scraper portion of scraper bar 63 to a specific height by directing protrusion 240 to selectively correspond either directly to, or proximate, one of the plurality of marks 243. In the present embodiment, a user may grasp adjustment member 230 and rotate it in a predetermined rotational direction to associate protrusion 240 with or proximate a selected one of the plurality of marks 243 in order to choose a suitable height at which the scraper portion of scraper bar 63 is desired to reside. Upon selected adjustment, securement element 216 may be threadably secured to second post 210 and tightened for securing scraper bar 63 at the adjusted height.

It will be generally understood that protrusion 240 and indicia 242 provide a useful assembly for indicating the height of the scraper portion of the scraper bar 63, and for allowing a user to selectively and accurately choose a height at which the scraper portion of the scraper bar 63 is desired to reside. In this fashion, the depth of layer 121 may be controlled with desired precision. It will be generally understood that although indicia 242 had been shown carried by lid 65, it may otherwise be carried elsewhere by wallpaper paste applying apparatus 50 operative for suitable association with protrusion 240 for allowing a user to easily ascertain and select the height of the scraper portion of the scraper bar 63 through adjustment thereof.

Figure 16:
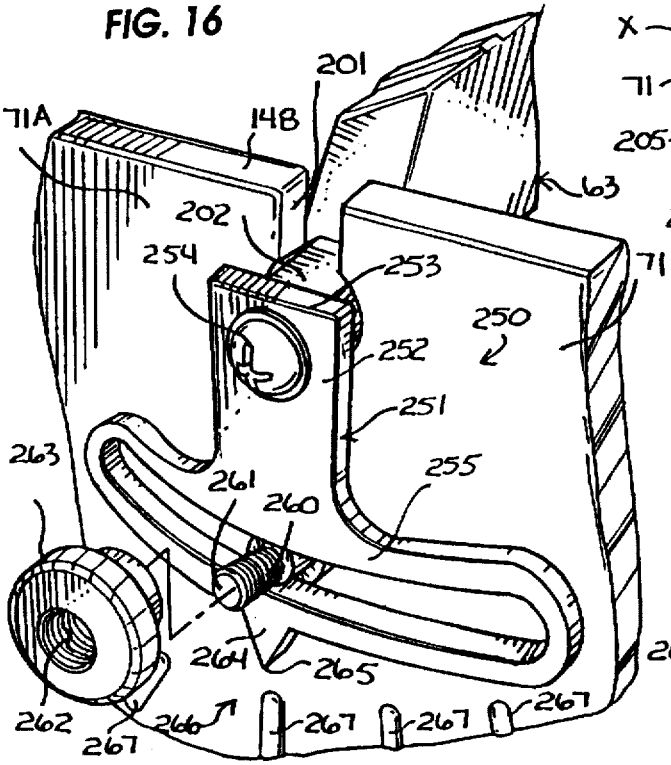
FIG. 16 is an enlarged fragmented perspective view of another alternate embodiment of an adjustment assembly operative for adjusting and indicating the height of a scraper bar.
Figure 17:
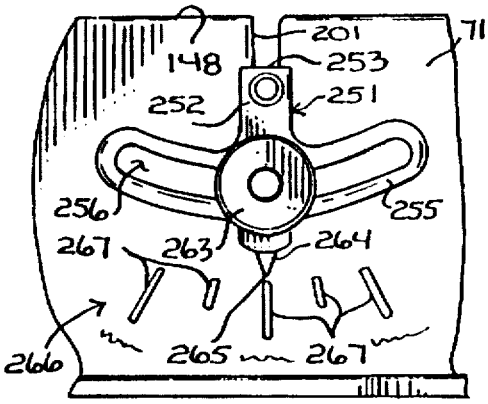
FIG. 17 is a side elevational view of the adjustment assembly of FIG. 16.

Attention is now directed to FIGS. 16–17, illustrating yet another alternate embodiment of an adjustment assembly 250 operative for adjusting and indicating the height of scraper bar 63 in accordance with the teachings of the present invention. In this embodiment, adjustment assembly 250 includes an adjustment member 251 including a body 252 having an upper end 253 rigidly and detachably coupled to the outer end of first post 202 by virtue of fastener 254, shown as a conventional threaded screw fastener. Body 252 extends downwardly from upper end 253 and terminates with a lower end defined as an elongate generally arcuate loop element 255 bounding a corresponding generally arcuate aperture 256. Adjustment assembly 250 further includes a engagement element 260 extending outwardly from outer surface 71A of sidewall 71, through arcuate aperture 256 and terminating with an outer end 261 at a point generally outboard of arcuate aperture 256. Engagement element 260 is threaded and thereby operative for threadably and detachably engaging a threaded bore 262 of a securement element 263 upon rotation of securement element 263 in a predetermined and selected direction, although this is not an essential feature of the present invention and other suitable engagement means may otherwise be used.

A pointer or protrusion 264 extends downwardly from loop element 255 and terminates with an outer end 265 formed generally in the form of a point which corresponds to indicia 266 carried by portions of sidewall 71 of housing 60 of wallpaper paste applying apparatus 50. Although indicia 266 may be provided in a variety of forms consistent with the teachings of the present invention, indicia 266 is preferably provided in the form marks 267 extending radially downwardly along sidewall 71, each one of the plurality of marks 267 corresponding to a predetermined height of the scraper portion of scraper bar 63. Thus, when adjusting the height of the scraper portion of scraper bar 63, a user may easily adjust the scraper portion of scraper bar 63 to a specific height by directing protrusion 264 to selectively correspond to or proximate one of the plurality of marks 267. In the present embodiment, a user may grasp adjustment member 230 and rotate or otherwise pivot it in a predetermined rotational direction to associate protrusion 264 with or proximate a selected one of the plurality of marks 267 in order to choose a selected height at which the scraper portion of scraper bar 63 is desired to reside. During adjustment this adjustment procedure, engagement element 260 will easily ride within elongate aperture 256. Nevertheless, upon selected adjustment, securement element 263 may be threadably secured to outer end 261 of engagement element 260 and tightened for securing body 252 of adjustment member against the outer surface 71A of sidewall 71 for securing the scraper portion of scraper bar 63 at a predetermined and selected height.

Figure 18:
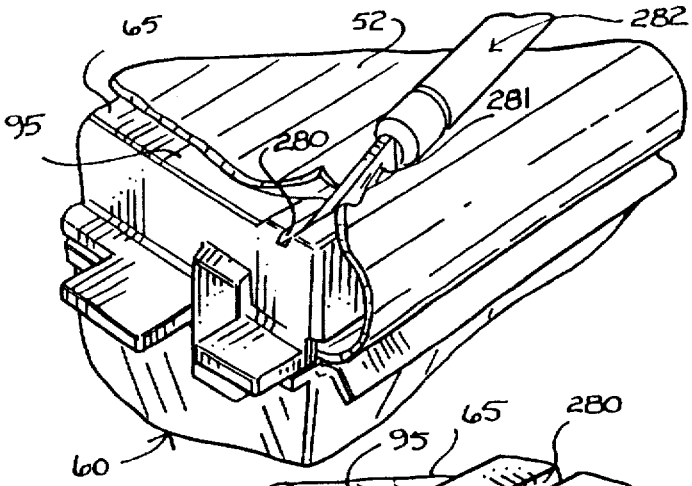
FIG. 18 is an enlarged fragmented perspective view of the wallpaper paste applying apparatus of FIG. 1 showing a knife cutting wallpaper through a groove carried by a lid.

It will be understood based on the foregoing discussions, that wallpaper paste applying apparatus 50 provides an easy and convenient system for applying paste to the back surface of wallpaper while allowing a user to easily adjusted the thickness and manner in which paste 55 may be applied to back surface 54. In this regard, normally after a length of wallpaper has been introduced through wallpaper paste applying apparatus 50, it may be necessary for a user to severe the length of wallpaper into a segment to facilitate ease of hanging. To carry out this task, panel 95 of lid 65 in FIG. 1 is provided with a channel 280 extending longitudinally therealong in a generally parallel relation relative leading edge 97. With additional reference to FIG. 18, to sever wallpaper 52, a user may overlap portions of wallpaper 52 extending outwardly from the upstream end 74 of wallpaper paste applying apparatus 50 so as to lay a portion of wallpaper 52 upon lid 65 so as to traverse channel 280. A user may then insert a cutting instrument, such as knife blade 281 of knife 282, through wallpaper 52 and into channel 280. The user may then draw the cutting instrument along the length of channel 280 thereby cutting through wallpaper 52 and hence severing wallpaper 52 in the process.

Figure 6:
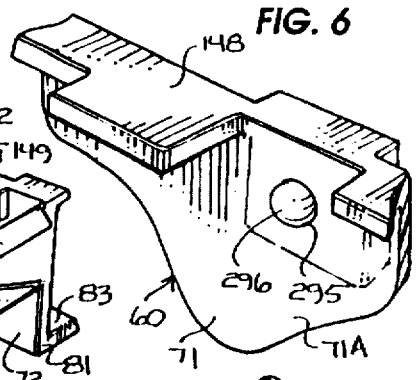
FIG. 6 is an enlarged fragmented perspective view of a protuberance extending outwardly from a sidewall of the trough shown in FIG. 5.
Figure 19:
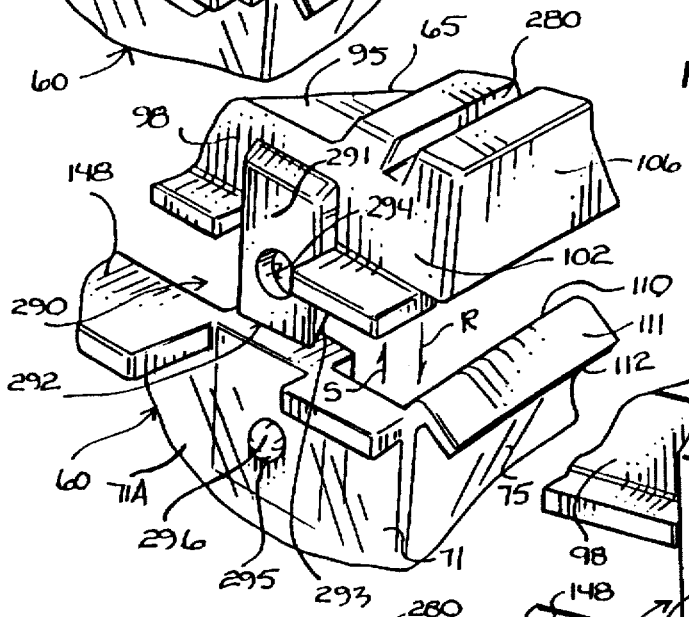
FIG. 19 is an enlarged fragmented perspective view of an engagement assembly operative for detachably engaging a lid of the wallpaper paste applying apparatus of FIG. 1 to a sidewall of a trough thereof.

With attention directed to FIG. 19, and as previously indicated, lid 65 is movable between an open allowing a user to easily access trough 61 for cleaning, and a closed position, and is detachably and removably engagable to trough 61 by virtue of an engagement assembly 290 carried by lid 65 and portions of sidewalls 71 and 72 of trough 61 proximate upstream end 74. As shown in FIG. 19 engagement assembly 290 includes an engagement element 291 carried by sidewall 98 of lid 65 and extending downwardly therefrom and terminating with a lower end 292 having a beveled surface 293 directed inward toward trough 61. Engagement element 291 further includes an aperture 294 extending therethrough somewhat spaced from lower end 292. Also provided is a complemental engagement element 295 extending outwardly from outer surface 71A of sidewall 71 of trough 61 and is provided generally in the form of a protuberance 296, also shown in FIG. 6.

Engagement element 291 is detachably engagable to complemental engagement element 295 upon application of compressive force to lid 65 in the direction indicated by the arrowed line R thereby facilitating engagement of beveled surface 293 against protuberance 296. Upon maintenance of the compressive force, beveled surface 293 will traverse protuberance 196 of which will receive into aperture 294 thereby detachably engaging engagement element 291 to complemental engagement element 295. To release engagement element 291 from complemental engagement element, a user need only grasp lower end 292 and pull it laterally outwardly to disengage aperture 294 from protuberance 296 after which lid 65 may be lifted away so disengaged in the direction indicated by the arrowed line S. Consistent with the foregoing discussion, an opposing engagement assembly, identical to engagement assembly 290, is also preferably provided in combination with sidewall 99 and sidewall 72 in a manner consistent herewith, further details of which will not be herein further discussed as it would be unnecessarily repetitive of which will also apply to the ensuing discussions regarding alternate embodiments of engagement assemblies to be presently discussed on combination with FIG. 20 and FIG. 21.

Figure 20:
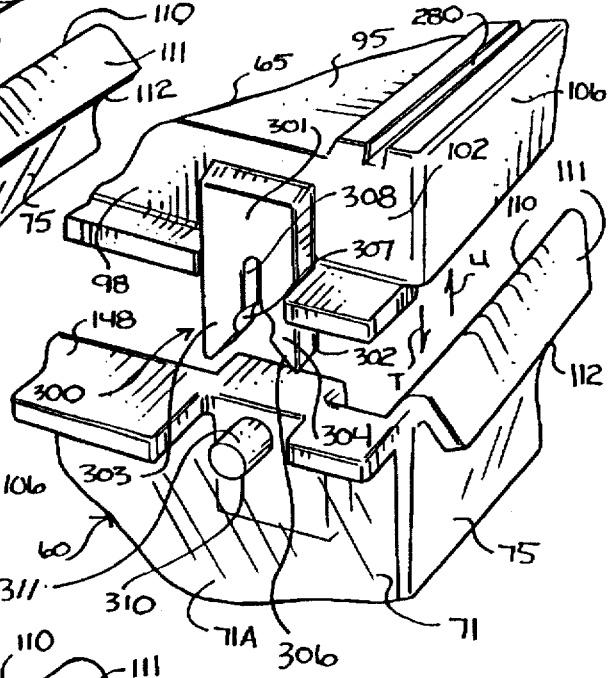
FIG. 20 is an enlarged fragmented perspective view of another embodiment of an engagement assembly operative for detachably engaging a lid of the wallpaper paste applying apparatus of FIG. 1 to a sidewall of a trough thereof.

In this regard, shown in FIG. 20 is an engagement assembly 300 including an engagement element 301 carried by sidewall 98 of lid 65 and extending downwardly therefrom and terminating with a lower end 302 furcated into branches 303 and 304. Branches 303 and 304 each include an inwardly facing beveled surface 305 and 306, respectively, contiguous with an enlarged portion 307 of a slot 308 extending upwardly into engagement element 301 from lower end 302. Also provided is a complemental engagement element 310 extending outwardly from outer surface 71A of sidewall 71 of trough 61 and is provided generally in the form of a cylindrical peg 311.

Engagement element 301 is detachably engagable to complemental engagement element 310 upon application of compressive force to lid 65 in the direction indicated by the arrowed line T thereby facilitating engagement of beveled surfaces 305 and 306 of branches 303 and 304 with peg 310. Upon maintenance of the compressive force, beveled surfaces 305 and 306 ride along peg pushing branches 303 and 304 apart until peg is admitted or received within enlarged portion 307. It will be generally understood that as branches 303 and 304 are pushed apart, a natural inward bias is imparted to branches 303 and 304 so that when peg is received within enlarged portion 307, branches 303 and 304 grip peg thereby engaging engagement element 301 to complemental engagement element 310 thereby imparting a natural inward bias to branches 303 and 304. To release engagement element 301 from complemental engagement element 310, a user need only grasp lid 65 and pull it upwardly in the direction indicated by the arrowed line U to disengage enlarged portion 307 from peg 311 after which lid 65 may be lifted away so disengaged.

Figure 21:
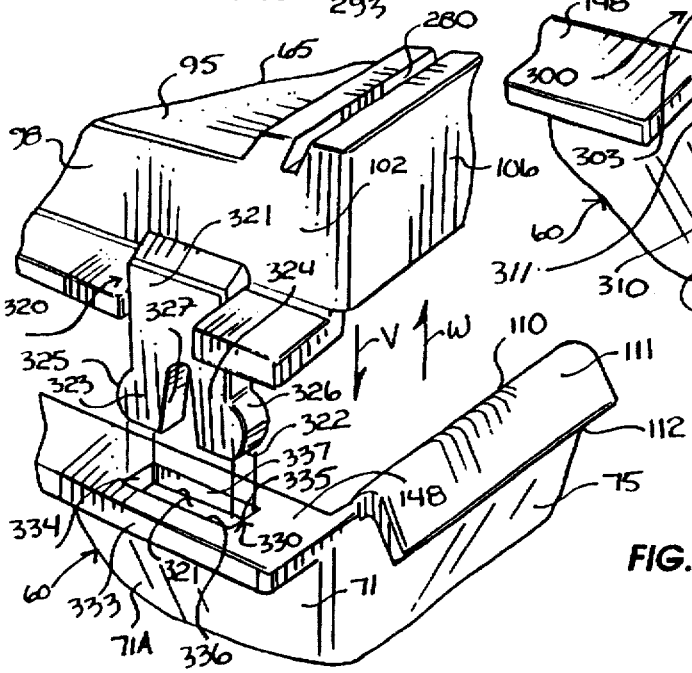
FIG. 21 is an enlarged fragmented perspective view of yet another embodiment of an engagement assembly operative for detachably engaging a lid of the wallpaper paste applying apparatus of FIG. 1 to a sidewall of a trough thereof.

With attention directed to FIG. 21, shown is yet another alternate embodiment of an engagement assembly 320 including an engagement element 321 carried by sidewall 98 of lid 65 and extending downwardly therefrom and terminating with a lower end 322 furcated into branches 323 and 324. Branches 323 and 324 each include an outwardly and laterally extending substantially outwardly arcuate protrusion 325 and 326 and are divided by virtue of a slot 327 extending inwardly into engagement element 321 from lower end 322. Also provided is a complemental engagement element 330 defined as an elongate aperture 331 extending through a flange 332 extending laterally outwardly from upper edge 148 and terminating with an outer end 333 terminating at a point generally outboard of outer surface 71A of sidewall 71. Elongate aperture 331 is generally rectangular as defined by spaced apart opposed endwalls 334 and 335 and spaced apart opposed sidewalls 336 and 337.

Engagement element 321 is detachably engagable to complemental engagement element 330 upon application of compressive force to lid 65 in the direction indicated by the arrowed line V thereby facilitating engagement of protrusions 325 and 326 with endwalls 334 and 335, respectively. Upon maintenance of the compressive force, protrusions 325 and 326 ride along endwalls 334 and 335 pushing branches 323 and 324 inwardly together until protrusions 325 and 326 pass through elongate aperture 331. It will be generally understood that as branches 323 and 324 are pushed inwardly together, a natural outward bias is imparted to branches 323 and 324 so that when protrusions 325 and 326 pass through elongate aperture 331, branches 323 and 324 snap outwardly apart to engage portions of flange 332 defining elongate aperture 331. To release engagement element 321 from complemental engagement element 330, a user need only grasp the lower ends of branches 323 and 324, urge them inwardly to disengage them from portions of flange 332 defining elongate aperture 331 and then pull lid 65 upwardly in the direction indicated by the arrowed line W removing branches 323 and 324 from elongate aperture 33 after which lid 65 may be lifted away so disengaged.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A wallpaper paste applying apparatus for applying paste to a surface of wallpaper, said wallpaper paste applying apparatus comprising:

a trough having an upstream end, a downstream end and opposing sidewalls;

an applicator roller carried by said trough;

a scraper bar adjustably carried by said trough upstream of and adjacent to said applicator roller, said scraper bar including an elongate member extending intermediate said opposing sidewalls of said trough and having a scraper portion located at a height proximate the back surface of the wallpaper to remove a predetermined amount of paste from the surface of the wallpaper, the scraper portion including an apex extending longitudinally along said elongate member, a beveled scraper surface contiguous with said apex and directed toward the surface of the wallpaper, said beveled scraper surface including a plurality of wales disposed therealong in spaced-apart relation and each separated by one of a plurality of valleys each having a predetermined depth, said apex and said plurality of wales to contact the surface of the wallpaper to remove paste therefrom to form a layer of paste upon the back surface of the wallpaper, and the layer defined by a plurality of ribs of paste corresponding to said plurality of valleys each separated by one of a plurality of grooves each formed by one of said plurality of wales;

an adjustment assembly carried by said scraper bar for adjusting the height of said scraper portion for allowing a user to adjust the amount of paste removed from the surface of the wallpaper;

a lid removably and hingedly coupled to said trough for movement between an open position and a closed position; and an outfeed roller carried proximate said trough upstream of said scraper bar.

2. A wallpaper paste applying apparatus for applying paste to a surface of wallpaper, said wallpaper paste applying apparatus comprising:

a trough having an upstream end, a downstream end and opposing sidewalls;

an applicator roller carried by said trough;

a scraper bar adjustably carried by said trough upstream of and adjacent to said applicator roller, said scraper bar including an elongate member extending intermediate said opposing sidewalls of said trough and having a scraper portion located at a height proximate the back surface of the wallpaper to remove a predetermined amount of paste from the surface of the wallpaper, a first post rigidly carried by said elongate member and extending outwardly from a first end thereof, a second post rigidly carried by said elongate member and extending outwardly from a second end thereof, said first post rotatably and removably receivable by a groove of one of said opposing sidewalls and extending outwardly therefrom and terminating with an outer end at a point generally outboard of an outer surface of the one of said opposing sidewalls, said second post rotatably and removably receivable by another groove of the other of said opposing sidewalls and extending outwardly therefrom and terminating with an outer end at a position generally outboard of an outer surface of the other of said opposing sidewalls, means carried by said scraper bar for rigidly securing said elongate member to said trough;

an adjustment assembly carried by said scraper bar for adjusting the height of said scraper portion for allowing a user to adjust the amount of paste removed from the surface of the wallpaper;

a lid removably and hingedly coupled to said trough for movement between an open position and a closed position; and an outfeed roller carried proximate said trough upstream of said scraper bar.

3. The wallpaper paste applying apparatus of claim 2, wherein said adjustment assembly includes an adjustment member rigidly carried proximate said outer end of said first post, said adjustment member movable in a predetermined direction for moving said scraper portion either toward or away from the surface of the wallpaper.

4. The wallpaper paste applying apparatus of claim 2, wherein said adjustment assembly further includes:

a pointer carried by said adjustment member; and indicia carried by said wallpaper paste applying apparatus corresponding to said pointer, said indicia defining varying degrees of height of said scraper portion.

5. The wallpaper paste applying apparatus of claim 4, wherein said means carried by said scraper bar for rigidly securing said elongate member to said trough further includes said adjustment member, said adjustment member movable between an unsecured position for allowing adjustment of said scraper portion and a secured position for securing said scraper portion at a predetermined height.

6. The wallpaper paste applying apparatus of claim 4, wherein said means carried by said scraper bar for rigidly securing said elongate member to said trough further includes a securement element carried proximate said outer end of said second post, said securement element movable between an unsecured position for allowing adjustment of said scraper portion and a secured position for securing said scraper portion at a predetermined height.

7. A wallpaper paste applying apparatus for applying paste to a surface of wallpaper, said wallpaper paste applying apparatus comprising:

a trough having an upstream end, a downstream end and opposing sidewalls;

an applicator roller carried by said trough;

a scraper bar adjustably carried by said trough upstream of and adjacent to said applicator roller, said scraper bar including an elongate member extending intermediate said opposing sidewalls of said trough and having a scraper portion located at a height proximate the back surface of the wallpaper to remove a predetermined amount of paste from the surface of the wallpaper;

an adjustment assembly carried by said scraper bar for adjusting the height of said scraper portion for allowing a user to adjust the amount of paste removed from the surface of the wallpaper;

a lid removably and hingedly coupled to said trough for movement between an open position and a closed position, the lid including a panel having a trailing edge pivotally and removably mounted proximate said downstream end of said trough and a leading edge, and a pair of engagement assemblies each carried proximate said leading edge of said panel of said lid and proximate said upstream end of said trough, each one of said pair of engagement assemblies for detachably engaging said leading edge of said panel to said trough proximate said upstream end; and an outfeed roller carried proximate said trough upstream of said scraper bar.

8. The wallpaper paste applying apparatus of claim 7, wherein each one of said pair of engagement assemblies includes an engagement element of an engagement pair extending downwardly proximate said leading edge of said panel, and a complemental engagement element of said engagement pair carried by said trough proximate said upstream end, said engagement element detachably engagable to said complemental engagement element for allowing a user to selectively close and open said lid.

9. The wallpaper paste applying apparatus of claim 8, wherein said element of said engagement pair includes a lower end having a beveled surface directed inward toward said trough and an aperture extending therethrough somewhat spaced from said lower end.

10. The wallpaper paste applying apparatus of claim 9, wherein said complemental engagement element of said engagement pair includes a protuberance carried by said trough and extending outwardly therefrom, said beveled surface of said engagement element to engage said protuberance upon application of downward compressive force to said lid toward said trough, wherein upon maintenance of the compressive force, beveled surface to traverse said protuberance of which will receive into said aperture of said engagement element thereby detachably engaging said engagement element to said complemental engagement element.

11. The wallpaper paste applying apparatus of claim 8, wherein said engagement element of said engagement pair includes a lower end furcated into a pair of branches, each one of said pair of branches including an inwardly facing beveled surface contiguous with an enlarged portion of a slot extending upwardly into said engagement element from said lower end.

12. The wallpaper paste applying apparatus of claim 11, wherein said complemental engagement element of said engagement pair includes a peg carried by said trough and extending outwardly therefrom, each said inwardly facing beveled surface of said engagement element to engage said peg upon application of downward compressive force to said lid toward said trough, wherein upon maintenance of the compressive force, each said inwardly facing beveled surface to ride along said peg pushing said pair of branches apart to admit peg within said enlarged portion.

13. The wallpaper paste applying apparatus of claim 8, wherein said engagement element of said engagement pair includes a lower end furcated into a pair of branches divided by a slot, each one of said pair of branches including an outwardly and laterally extending protrusion.

14. The wallpaper paste applying apparatus of claim 13, wherein said complemental engagement element of said engagement pair includes an aperture extending through a flange extending laterally outwardly from said trough, said aperture provided generally in the form of a rectangle defined by a pair of spaced-apart opposed endwalls and a pair of spaced-apart opposed sidewalls, each said laterally extending protrusion of each one of said pair of branches to engage a respective one of said pair of spaced-apart opposed endwalls upon application of downward compressive force to said lid toward said trough, wherein upon maintenance of the compressive force, each said laterally extending protrusion to ride along a respective of said pair of spaced-apart opposed endwalls thereby pushing said pair of branches inwardly together thereby imparting an outwardly directed bias to each one of said pair of branches until said laterally extending protrusions pass through said aperture wherein each one of said pair of branches snap outwardly engaging said pair of spaced-apart opposed endwalls of said aperture.

15. The wallpaper pasting apparatus of claim 7, wherein:

said lid further includes an upstream endwall extending downwardly from said leading edge of said panel and terminating with a lower edge;

said trough further including an upstream panel extending upwardly from said upstream endwall and terminating with an upper edge;

said lower edge of said upstream endwall of said lid adjacent and spaced from said upper edge of said upstream panel of said trough when in the closed position to form a slot operative for receiving wallpaper into said wallpaper pasting apparatus.

16. The wallpaper paste applying apparatus of claim 7, wherein said lid further includes:

an inner surface directed toward said applicator roller;

a first member depending from said inner surface of said lid and terminating with a lower end;

a second member spaced from said first member, depending from said inner surface of said lid and terminating with a lower end;

wherein when said lid is disposed in the closed position, said lower end of said first member resides intermediate said applicator roller and said upstream end subjacent an apex of said applicator roller, and said lower end of said second member resides intermediate said applicator roller and said scraper bar subjacent said apex of said applicator roller and subjacent said scraper portion of said scraper bar, said first member and said second member being operative for holding the wallpaper onto and over said applicator roller as the wallpaper is fed through said wallpaper paste applying apparatus.

17. In combination with a wallpaper paste applying apparatus for applying paste to a surface of wallpaper of a type having a trough with an upstream end, a downstream end, opposing sidewalls and an applicator roller carried by the trough, a scraper bar carried by said trough upstream of said applicator roller to remove paste from the surface of the wallpaper, said scraper bar comprising:

an elongate member extending intermediate the opposing sidewalls of the trough and having a scraper portion located at a height proximate the back surface of the wallpaper to remove a predetermined amount of paste from the surface of the wallpaper said scraper portion including an apex extending longitudinally along said elongate member, a beveled scraper surface contiguous with said apex and directed toward the surface of the wallpaper, said beveled scraper surface including a plurality of wales disposed therealong in spaced-apart relation and each separated by one of a plurality of valleys each having a predetermined depth, said apex and said plurality of wales to contact the surface of the wallpaper to remove paste therefrom to form a layer of paste upon the back surface of the wallpaper, the layer defined by a plurality of ribs of paste corresponding to said plurality of valleys each separated by one of a plurality of grooves each formed by one of said plurality of wales.

18. In combination with a wallpaper paste applying apparatus for applying paste to a surface of wallpaper of a type having a trough with an upstream end, a downstream end, opposing sidewalls and an applicator roller carried by the trough, an adjustable scraper bar assembly carried by said trough upstream of said applicator roller to remove paste from the surface of the wallpaper, said adjustable scraper bar assembly comprising:

an elongate member extending intermediate the opposing sidewalls of the trough and having a scraper portion located at a height proximate the back surface of the wallpaper to remove a predetermined amount of paste from the surface of the wallpaper, the scraper portion including an apex extending longitudinally along said elongate member, a beveled scraper surface contiguous with said apex and directed toward the surface of the wallpaper, said beveled scraper surface including a plurality of wales disposed therealong in spaced-apart relation and each separated by one of a plurality of valleys each having a predetermined depth, said apex and said plurality of wales to contact the surface of the wallpaper to remove paste therefrom to form a layer of paste upon the back surface of the wallpaper, the layer defined by a plurality of ribs of paste corresponding to said plurality of valleys each separated by one of a plurality of grooves each formed by one of said plurality of wales; and an adjustment assembly carried by said scraper bar for adjusting the height of said scraper portion for allowing a user to adjust the amount of paste removed from the surface of the wallpaper.

19. In combination with a wallpaper paste applying apparatus for applying paste to a surface of wallpaper of a type having a trough with an upstream end, a downstream end, opposing sidewalls and an applicator roller carried by the trough, an adjustable scraper bar assembly carried by said trough upstream of said applicator roller to remove paste from the surface of the wallpaper, said adjustable scraper bar assembly comprising:

an elongate member extending intermediate the opposing sidewalls of the trough and including a scraper portion located at a height proximate the back surface of the wallpaper to remove a predetermined amount of paste from the surface of the wallpaper;

an adjustment assembly carried by said scraper bar for adjusting the height of said scraper portion for allowing a user to adjust the amount of paste removed from the surface of the wallpaper, the adjustment assembly including a first post rigidly carried by said elongate member and extending outwardly from a first end thereof, a second post rigidly carried by said elongate member and extending outwardly from a second end thereof, said first post rotatably and removably receivable by a groove of one of the opposing sidewalls and extending outwardly therefrom and terminating with an outer end at a point generally outboard of the one of the opposing sidewalls, said second post rotatably and removably receivable by another groove of the other of the opposing sidewalls and extending outwardly therefrom and terminating with an outer end at a position generally outboard of the other of the opposing sidewalls, said adjustment assembly carried proximate said outer end of said first post, and means carried by said scraper bar for rigidly securing said elongate member to the trough.

20. The adjustable scraper bar assembly of claim 19, wherein said adjustment assembly includes an adjustment member rigidly carried proximate said outer end of said first post, said adjustment member movable in a predetermined direction for moving said scraper portion either toward or away from the surface of the wallpaper.

21. The adjustable scraper bar assembly of claim 20, wherein said adjustment assembly further includes:

a pointer carried by said adjustment member; and indicia carried by the wallpaper paste applying apparatus corresponding to said pointer, said indicia defining varying degrees of height of said scraper portion.

22. The adjustable scraper bar assembly of claim 21, wherein said means carried by said scraper bar for rigidly securing said elongate member to the trough further includes said adjustment member, said adjustment member movable between an unsecured position for allowing adjustment of said scraper portion and a secured position for securing said scraper portion at a predetermined height.

23. The adjustable scraper bar assembly of claim 21, wherein said means carried by said scraper bar for rigidly securing said elongate member to the trough further includes a securement element carried proximate said outer end of said second post, said securement element movable between an unsecured position for allowing adjustment of said scraper portion and a secured position for securing said scraper portion at a predetermined height.

* * * * *